US009719236B2

(12) United States Patent
Schmitt et al.

(10) Patent No.: US 9,719,236 B2
(45) Date of Patent: Aug. 1, 2017

(54) TOP-MOUNT TWIST-ON FAUCET

(71) Applicant: Watts Water Technologies, Inc., North Andover, MA (US)

(72) Inventors: Craig A. Schmitt, Phoenix, AZ (US); Adam J. Becker, Scottsdale, AZ (US)

(73) Assignee: WATTS REGULATOR CO., North Andover, MA (US)

( * ) Notice: Subject to any disclaimer, the term of this patent is extended or adjusted under 35 U.S.C. 154(b) by 373 days.

(21) Appl. No.: 14/519,417

(22) Filed: Oct. 21, 2014

(65) Prior Publication Data

US 2015/0107019 A1 Apr. 23, 2015

Related U.S. Application Data

(60) Provisional application No. 61/893,403, filed on Oct. 21, 2013.

(51) Int. Cl.
*E03C 1/04* (2006.01)

(52) U.S. Cl.
CPC ..... *E03C 1/04* (2013.01); *E03C 2001/0416* (2013.01)

(58) Field of Classification Search
CPC ..... E03C 1/04; E03C 1/0402
USPC ..... 4/678
See application file for complete search history.

(56) References Cited

U.S. PATENT DOCUMENTS

| | | | | |
|---|---|---|---|---|
| 4,553,277 | A | 11/1985 | Duncan | |
| 5,010,922 | A | 4/1991 | Agresta | |
| 5,388,287 | A | 2/1995 | Tischler et al. | |
| 6,138,296 | A | 10/2000 | Baker | |
| 6,301,728 | B1 | 10/2001 | Pilatowicz et al. | |
| 6,328,059 | B1 | 12/2001 | Testori et al. | |
| 7,017,600 | B2 | 3/2006 | Klein | |
| 8,051,507 | B2 * | 11/2011 | Lin | E03C 1/04 137/603 |
| 2002/0164205 | A1 * | 11/2002 | Kresge | F16D 1/112 403/322.1 |
| 2003/0204906 | A1 | 11/2003 | Tsutsui et al. | |
| 2004/0094202 | A1 | 5/2004 | Kawolics et al. | |

* cited by examiner

*Primary Examiner* — Christine Skubinna
(74) *Attorney, Agent, or Firm* — Burns & Levinson LLP; George N. Chaclas

(57) ABSTRACT

A top-mount faucet assembly includes a coupling mounted on a counter that selectively couples a faucet thereto. The counter coupling has a disc-shaped collar with two keepers and a land for selectively locking the faucet. The land has a v-shaped part and a n-shaped part. The faucet has a main valve body with a locking assembly. To couple the faucet to the counter coupling, the main valve body is placed over the coupling and turned clockwise so that slots align with the keepers to fix the faucet axially to the coupling. As the faucet rotates clockwise, the locking assembly rides along the v-shaped part until captured by the n-shaped part to lock the faucet in place rotationally. To uncouple the faucet from the coupling, a button is pushed so that the locking assembly moves radially inward out from the n-shaped part, then the faucet is turned counter-clockwise.

2 Claims, 10 Drawing Sheets

TOP-MOUNT TWIST-ON FAUCET

CROSS-REFERENCE TO RELATED APPLICATION

This application claims priority to U.S. Provisional Patent Application No. 61/893,403, filed Oct. 21, 2013, which is incorporated herein by reference.

BACKGROUND

1. Field

The subject disclosure relates to faucet assemblies, and more particularly to an improved faucet assembly for reverse osmosis water filtration systems that easily and effectively mounts on a counter.

2. Background

In conventional faucet assemblies, the mounting of the faucet assembly, including the spout thereof, is completed from the underside of the counter to which the faucet assembly is mounted. Assembly and mounting from the underside of the deck is often awkward and uncomfortable for the installer. As a result, assembly frequently varies and can be quite unreliable.

SUMMARY OF THE INVENTION

The subject technology provides an easy connect and disconnect faucet that is mounted to the deck from above the deck, that is simple in construction, economical to produce and highly reliable in operation. The subject technology provides a coupling that mounts on the counter and permits the faucet to be removed without disassembling the water supply lines. These operations can be performed with a minimum of tools or steps. Once removed from the coupling, the faucet is replaced with another faucet of a similar style or a different style without adaptation of the coupling.

In one embodiment, a top-mount twist-on faucet assembly includes a counter coupling and a faucet. The counter coupling has: a disc-shaped collar defining holes for mounting to a counter; a lower portion depending from the disc-shaped collar for coupling to a water source; an upper tube extending from the disc-shaped collar for coupling to the faucet; at least one keeper on the disc-shaped collar having an upper flange that forms a channel; and at least one land having a first part shaped like a "v" and a second part shaped like an "n" with respect to an axial center.

The faucet has: a main body defining an axial bore and a release assembly passageway transverse to the bore; a bottom plate on the main body with slots for engaging the keeper; a dispensing tube extending from the main body; a locking assembly in the main body for coupling to the at least one land to selectively couple the faucet to the counter coupling. The locking assembly includes a release button spring loaded radially outward and a pin depending from the release button into the release assembly passageway. Upon radially inward depression of the release button, the depending pin moves radially inward.

To couple the faucet to the counter coupling, the main body is placed over upper portion and turned clockwise so that the slotted plate of the faucet goes over the flange to align with the channel of the keeper to fix the faucet axially to the counter coupling. Then, the faucet is rotated clockwise so that the depending pin rides along an outside of the first "v" part until the depending pin is captured by nesting in the second "n" part to rotationally lock the faucet in place.

To uncouple the faucet from the counter coupling, the release button is pushed so that the depending pin moves out from nesting in the second "n" part. Then, the main body is turned counter-clockwise so that the depending pin rides again along an outside of the first "v" part and the slotted plate comes out of the channel of the flange of the keeper so that the faucet can be removed from the upper portion. A banking surface land on the counter coupling to may further stabilize the faucet when coupled to the counter coupling. Preferably, two opposing keepers are sized so that a turn of approximately 45 degrees couples and uncouples the faucet from the counter coupling.

In another embodiment, the subject technology is directed to a top-mount twist-on faucet assembly including a counter coupling having a disc-shaped collar. The collar defines holes for mounting to a counter. A lower portion of the counter coupling depends from the disc-shaped collar for coupling to a water source. An upper portion of the counter coupling extends from the disc-shaped collar for coupling to a faucet by a threaded portion. The disc-shaped collar also has at least one land having a first part shaped like a "v" and a second part shaped like an "n" with respect to an axial center.

The faucet has a main body defining an axial threaded bore for engaging a threaded portion of the faucet. The faucet has a dispensing tube or spout on an upper end. There is a release assembly passageway transverse to the bore and a locking assembly moving in the passageway. The locking assembly rotationally couples the faucet to the at least one land of the counter coupling. The locking assembly includes a release button spring loaded radially outward. A pin depends into the passageway and couples to the release button such that upon depression of the release button, the depending pin moves radially inward.

To couple the faucet to the counter coupling, the main body is placed over upper portion and turned clockwise so that the threaded part engages the threaded bore and the depending pin rides along the first "v" part until the depending pin is captured by nesting in the second "n" part. To uncouple the faucet from the counter coupling, the release button is pushed so that the depending pin moves out from nesting in the second "n" part (e.g., radially inward), then main body is turned counter-clockwise so that the depending pin rides again along an outside of the first "v" part and the faucet is unthreaded from the threaded portion of the upper portion.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
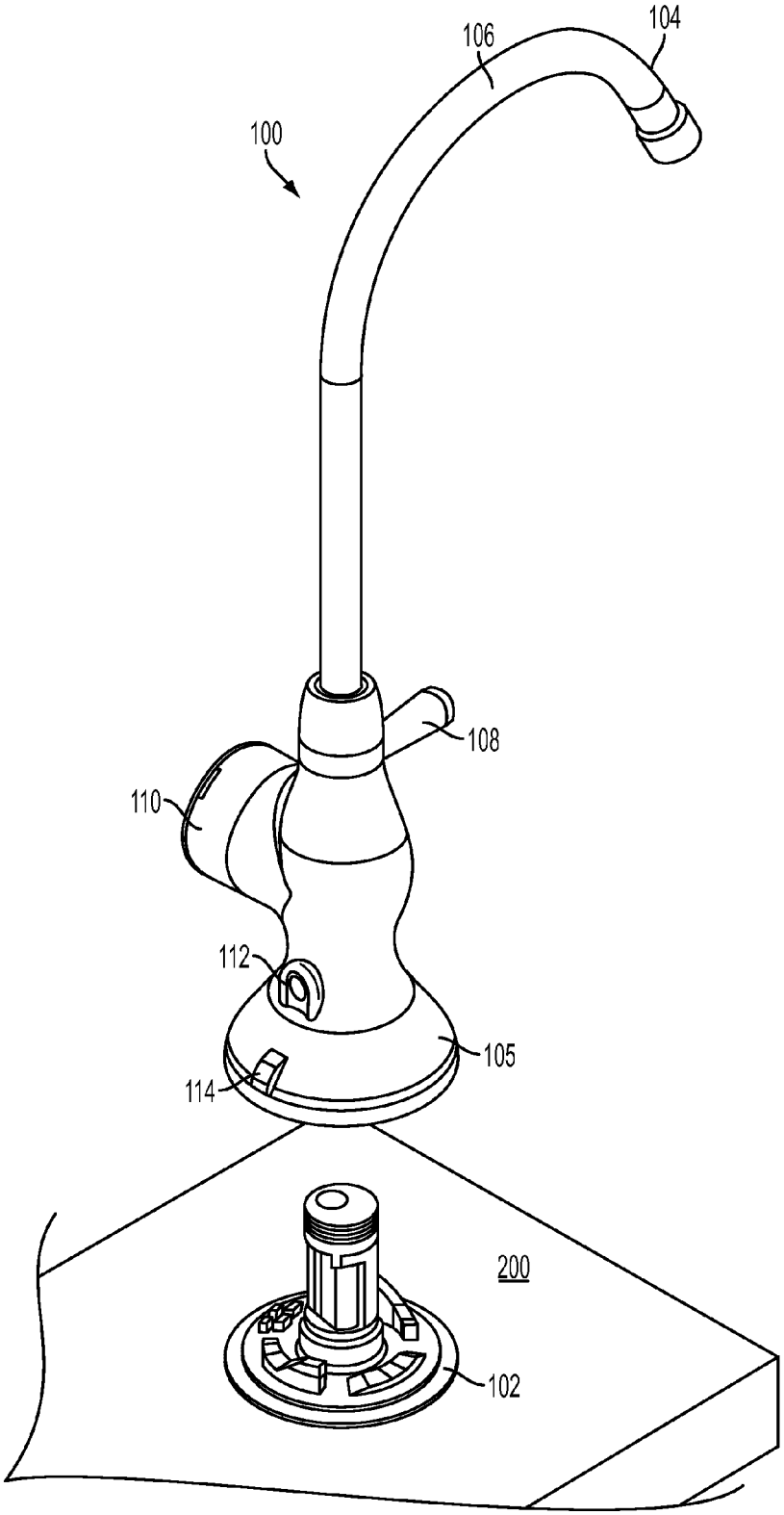
FIG. 1 is an exploded perspective view of a top-mount twist-on faucet assembly with the counter coupling mounted on a counter in accordance with the subject technology.
Figure 4:
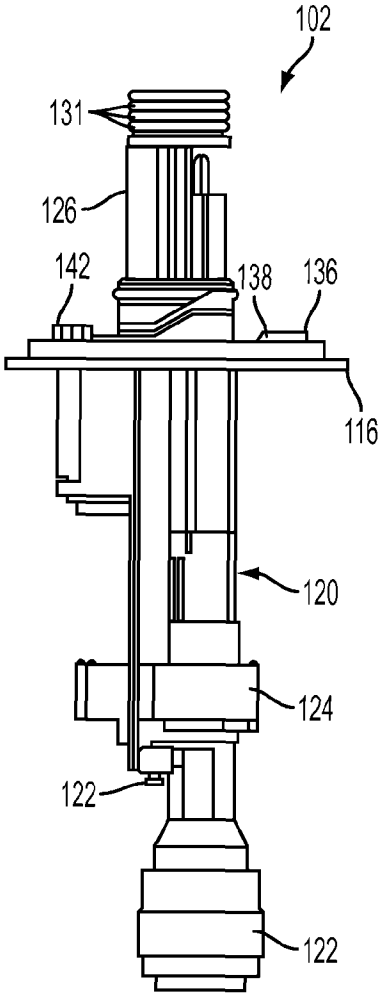
FIG. 4 is another side view of the counter coupling of FIG. 2.
Figure 3:
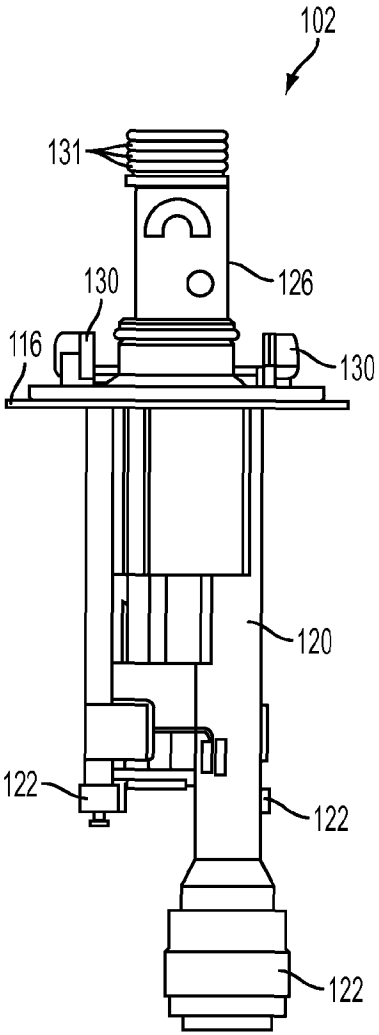
FIG. 3 is a side view of the counter coupling of FIG. 2.
Figure 2:
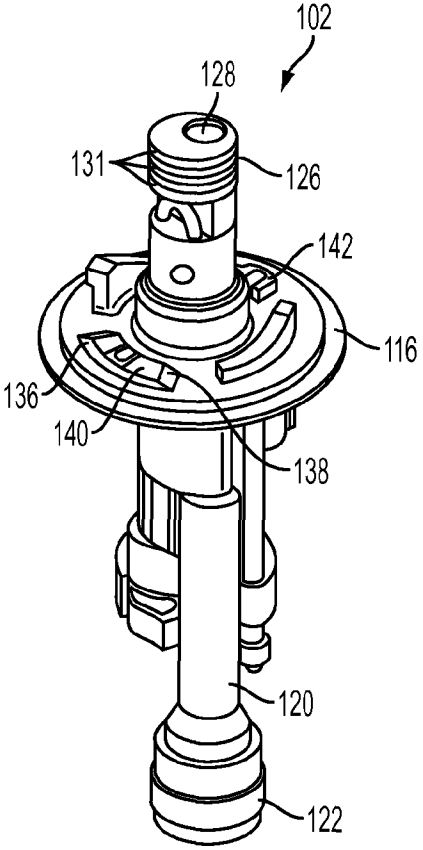
FIG. 2 is perspective view of a counter coupling for use with the faucet assembly of FIG. 1.
Figure 6:
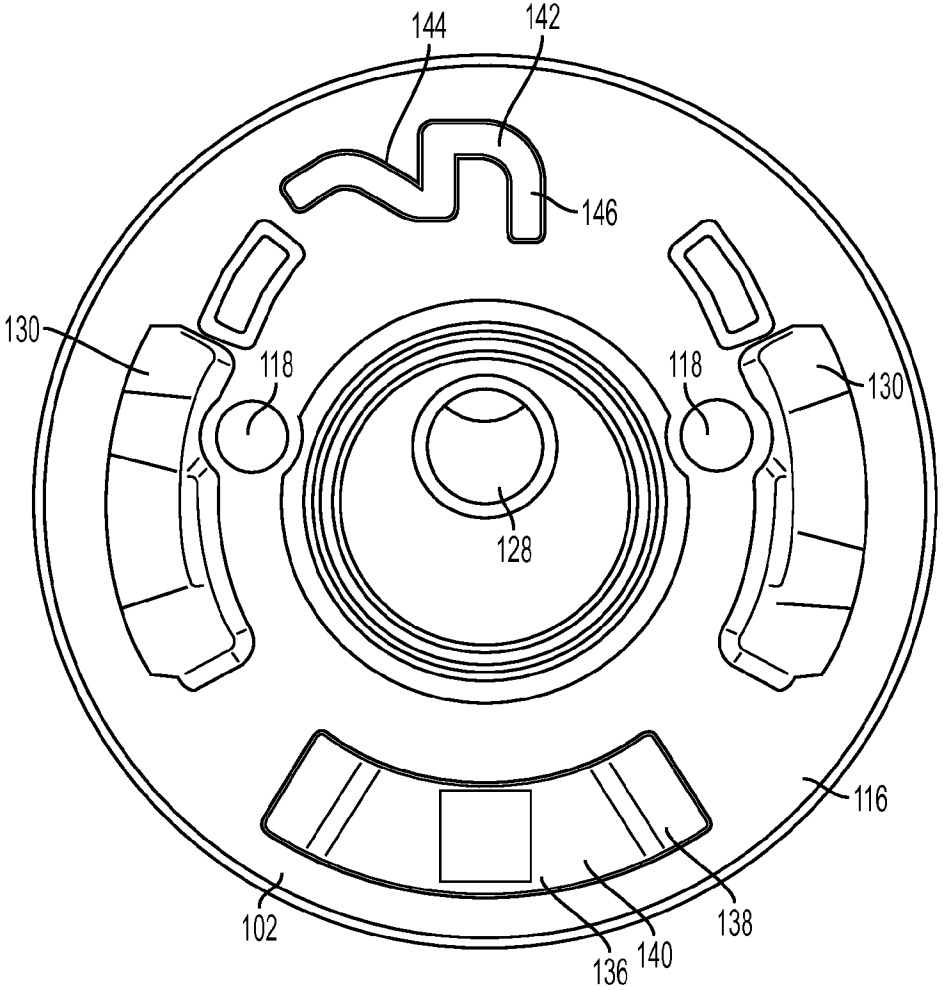
FIG. 6 is a top view of the counter coupling of FIG. 2.
Figure 5:
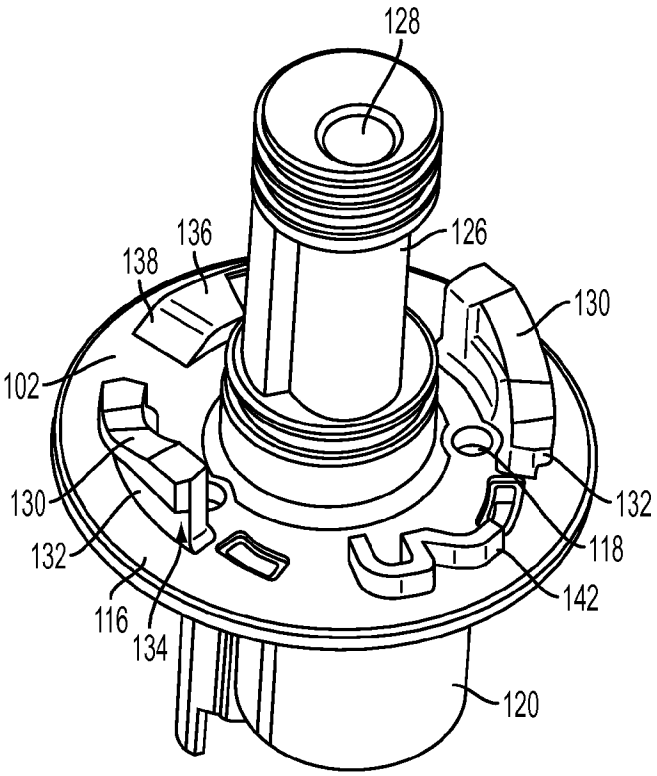
FIG. 5 is an alternative partial perspective view of the counter coupling of FIG. 2.
Figure 7:
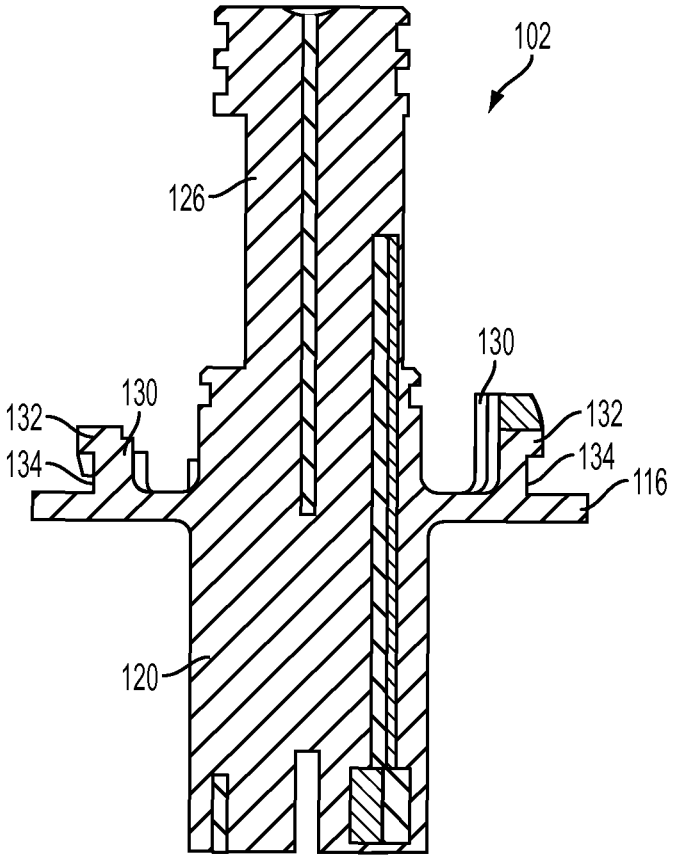
FIG. 7 is another side view of the counter coupling of FIG. 2.

The present invention overcomes many of the problems associated with the prior art faucet assemblies. In brief overview, the subject technology includes a counter-top faucet assembly allows for easy removal and replacement of a faucet portion while a counter-top portion remains permanently fixed to the counter. The advantages, and other features of the assemblies and methods disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology. All relative descriptions herein such as left, right, up, and down are with reference to the Figures, and not meant in a limiting sense. Below is Table 1, which provides a general parts list.

TABLE 1

| General Parts List |
|---|
| Faucet assembly 100 |
| Faucet 104 |
| Spout 106 |
| Handle 108 |
| Battery section 110 |
| AG out hole 112 |
| Release button assembly 114 |
| Valve body 150 |
| Screws 152 |
| holes 153 |
| axial bore 154 |
| release assembly passageway 156 |
| bottom circular plate 158 |
| slots 160 |
| relativley narrow portion 168 |
| relatively wide portion 170 |
| angled outside portion 172 |
| dispensing tube 162 |
| threaded end 164 |
| locking/release button assembly 166 |
| pin 167 |
| Counter coupling 102 |
| disc-shaped collar 116 |
| holes 118 |
| lower portion 120 |
| quick connect fittings 122 |
| locking tabs 124 |
| upper portion 126 |
| passageway 128 |
| keepers 130 |
| sealing rings 131 |
| flanges 132 |
| channel 134 |
| banking surface land 136 |
| ramp area 138 |
| plateau area 140 |
| locking land 142 |
| v-shaped part 144 |
| n-shaped part 146 |
| Counter 200 |

Now referring to FIG. 1, an exploded perspective view of a top-mount twist-on faucet assembly 100 is shown. The faucet assembly 100 includes a counter coupling 102 and a faucet 104. The counter coupling 102 mounts to a sink, deck or counter 200 (as shown). The faucet 104 then connects and deconnects to the counter coupling 102 without the use of tools. The counter coupling 102 has additional features below the counter 200 for connecting to the water lines as discussed below.

The faucet 104 includes a spout portion 106 extending up from a base 105. The spout portion 106 dispenses water when the handle 108 is turned to the open position. The faucet 104 also includes a replaceable battery section 110 for powering an indicator that indicates water quality. To mount the faucet 104 on the counter coupling 102, the faucet 104 is placed over the counter coupling 102 and rotated about 45 degrees clockwise. To remove the faucet 104 from the counter coupling 102, a release button assembly 114 is depressed while the faucet 104 is rotated about 45 degrees counter-clockwise and then lifted upward. The mounting and unmounting operation of the faucet 104 is discussed further below.

Counter Coupling

Referring now to FIGS. 2-7 perspective, side and top views of counter coupling 102 are shown. The counter coupling 102 has a disc-shaped collar 116 defining holes 118 for mounting to the counter 200. A lower portion 120 depending from the disc-shaped collar 116 couples to a water source. Preferably, the lower portion 120 has quick connect fittings 122*a-c* for connecting to drinking water, drain saddle and system drain as the faucet assembly 100 may connect to a reverse osmosis water supply (not shown). The quick fittings 122*a-c* can use collet and ferrule or any other technology known to make fast and easy fluid connections. Locking tabs 124 hold the fittings 122 in place.

A tubular upper portion 126 extends upward from the collar 116 for coupling to the faucet 104. The upper portion 126 forms a passageway 128 for the drinking water, which is surrounded by one or more outer sealing rings 131. Although the upper portion 126 supports the faucet 104, the faucet 104 has a valve body 150 (described below) that interacts with the collar 116 to lock the collar 116 and faucet 104 together.

The collar 116 has two keepers 130 with upper flanges 132 to form a slanted channel 134. The keepers 130 are on opposing sides of the upper portion 126. On the front side of the collar 116, there is a banking surface land 136 intermediate the keepers 130. The banking surface land 136 has a ramp area 138 that leads to a plateau area 140.

On the back side of the collar 116, there is a locking land 142 intermediate the keepers 130 opposing the banking surface land 136. The locking land 142 has an irregular shape but generally arcuate as seen from above. The locking land 142 has a v-shaped part 144 and an n-shaped part 146 with respect to an axial center (i.e., the "v" and the "n" are facing radially inward as if written on an arcuate line). The keepers 130, banking surface land 136 and locking land 140 are all generally arcuate, about 45 degrees in length, and spaced about 45 degrees apart.

Faucet

Figure 8:
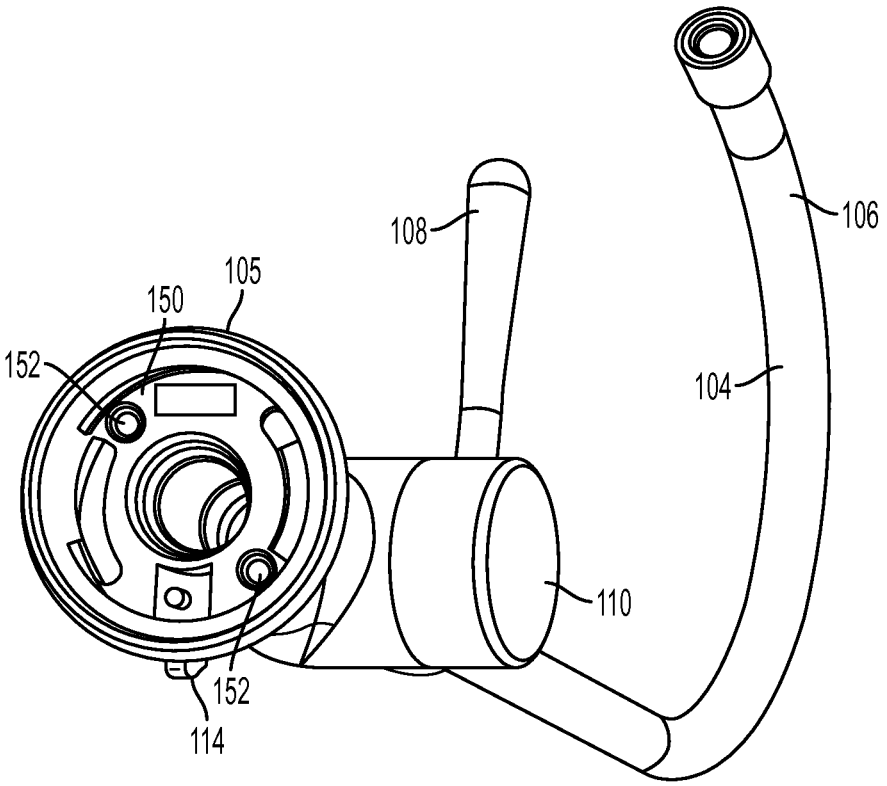
FIG. 8 is bottom perspective view of a faucet for use with the faucet assembly of FIG. 1.
Figure 10:
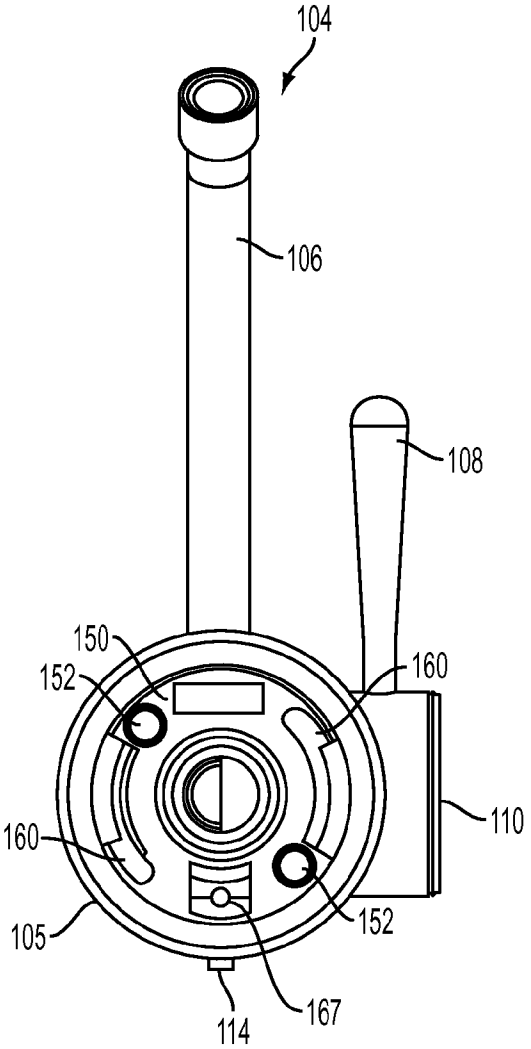
FIG. 10 is a bottom view of the faucet of FIG. 8.
Figure 9:
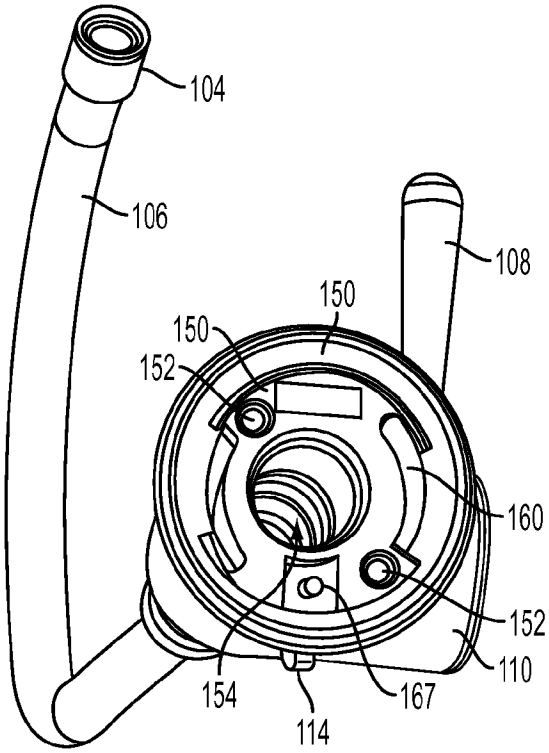
FIG. 9 is another bottom perspective view of the faucet of FIG. 8.
Figure 11:
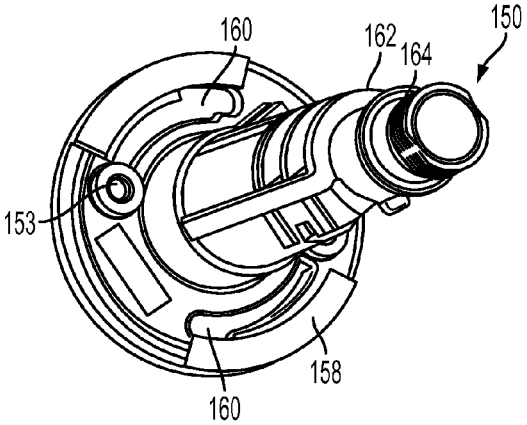
FIG. 11 is top perspective view of a main valve body for use with the faucet of FIG. 8.

Referring now to FIGS. 8-10, various bottom perspective views of a faucet 104 for use with the faucet assembly 100 of FIG. 1 is shown. The faucet 104 houses an inner main valve body 150. The main valve body 150 is coupled to the faucet base 105 by screws 152 through holes 153 so that the screws 152 thread into the base 105 of the faucet 104. The main valve body 150 may also be integrally formed with the faucet 104 or attach by snap-fit and the like.

Main Valve Body

Referring now to FIGS. 11-16, various views of the main valve body 150 are shown. The main valve body 150 defines an axial bore 154 through which the upper portion 126 of the counter coupling 102 passes. The main valve body 150 also defines a release assembly passageway 156 transverse to the axial bore 154. The main valve body 150 has a bottom circular plate 158 with two slots 160 for engaging the two keepers 130 of the counter coupling 102. The slots 160 have a relatively narrow portion 168 and a relatively wide portion 170 best seen in FIGS. 15 and 16. The main valve body 150 also has a dispensing tube 162 extending from the bottom circular plate 158. The dispensing tube 162 has a threaded end 164 onto which the spout 106 or other faucet component may sealing couple.

Figure 12A:
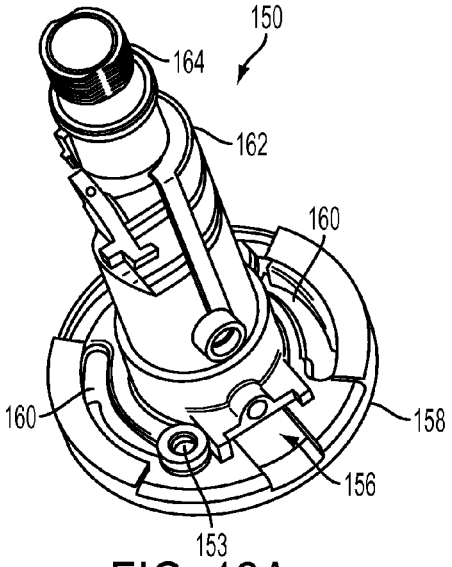
FIGS. 12A and 12B are another top perspective view of the main valve body of FIG. 8.
Figure 12B:
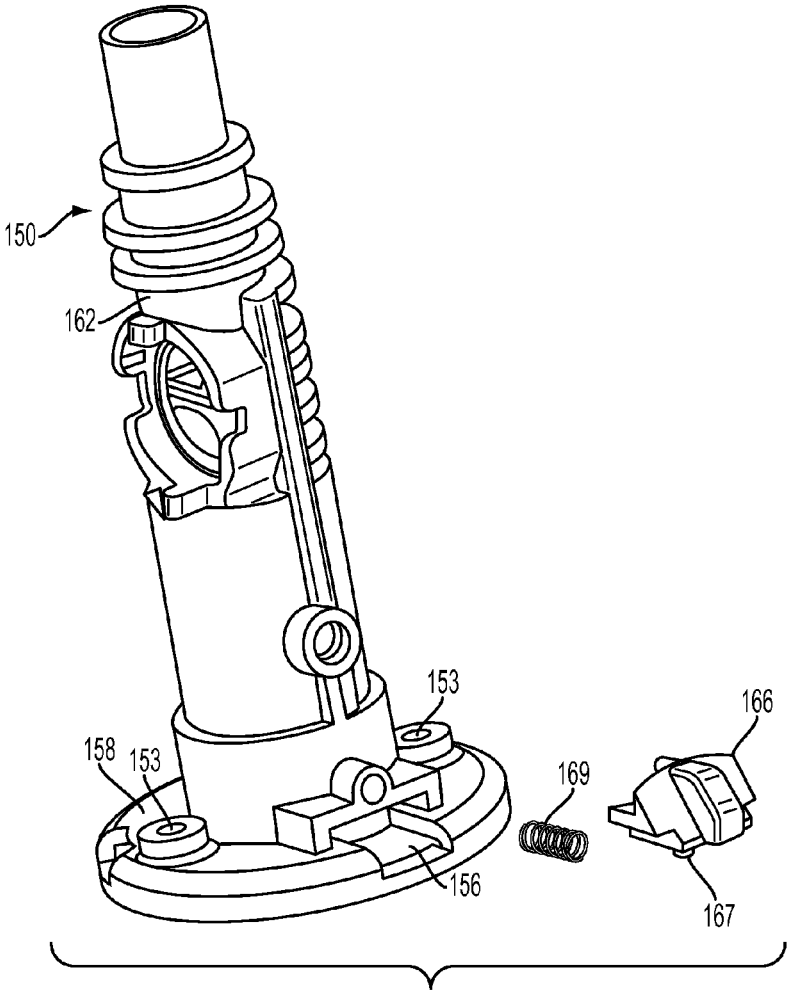
Figure 13:
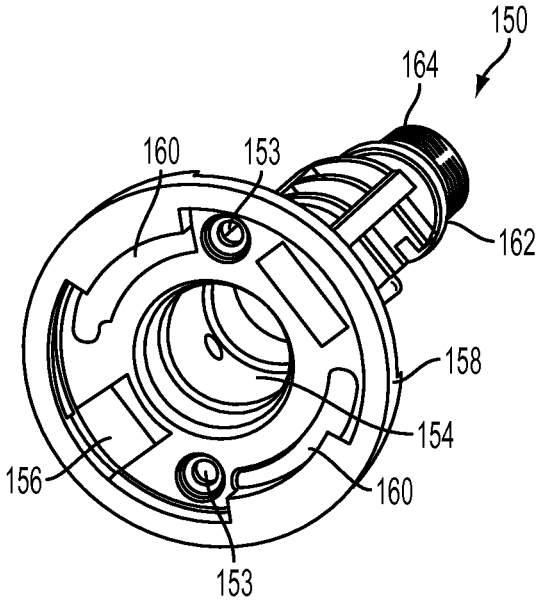
FIG. 13 is a bottom perspective view of the main valve body of FIG. 8.
Figure 14:
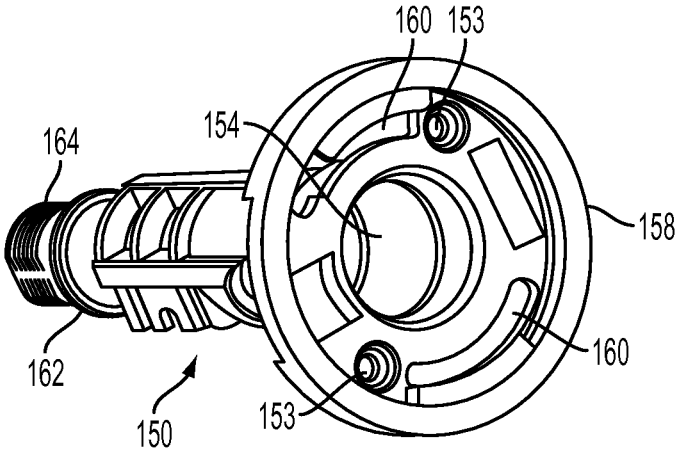
FIG. 14 is another bottom perspective view of the main valve body of FIG. 8.
Figure 16:
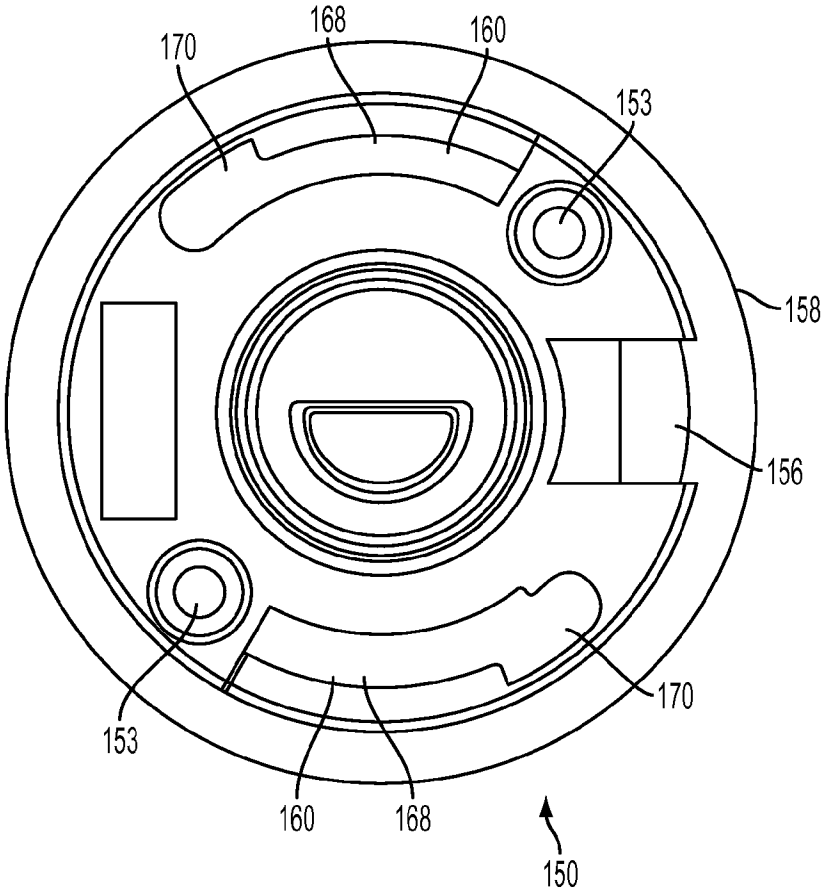
FIG. 16 is a bottom view of the main valve body of FIG. 8.
Figure 15:
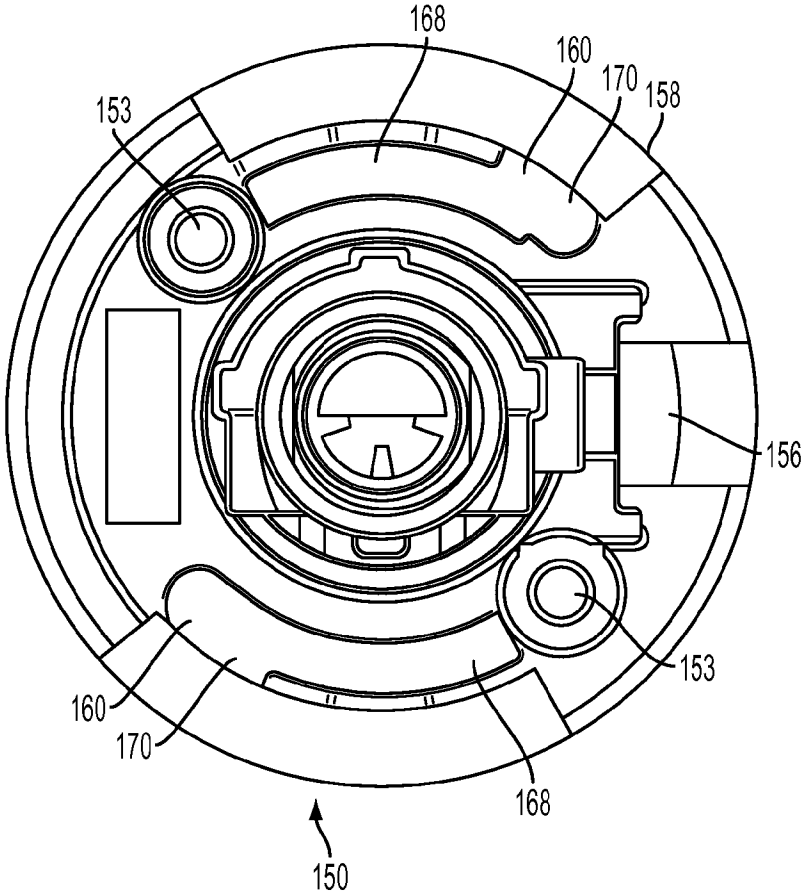
FIG. 15 is a top view of the main valve body of FIG. 8.

Referring now particularly to FIG. 12B, the faucet 104 also houses the release button assembly 114. The release button assembly 114 includes a button 166 and a spring 169. The release button assembly 114 extends radially through base 105 in the passageway 156. A pin 167 (also seen in FIGS. 17 and 18) depends from the button 166 into the passageway 156. The release button assembly 114 and, thereby, the pin 167 are loaded radially outward by the spring 169. Upon radially inward depression of the release button assembly 114, the depending pin 167 moves radially inward.

Assembly

To assemble the faucet assembly 100 to the counter 200, the counter coupling 102 is passed through a hole in the counter 200 and screwed down through holes 118. The main valve body 150 is also permanently attached to the faucet 104 by screws 152 in holes 153. It is envisioned that the main valve body 150 and the counter coupling 102 are a matched pair but could function equally well with a large variety of different designs for the faucet 104. Thus, designers, consumers and installers not only have an easy and convenient ability to replace worn out faucets, but a large variety of design choices.

Once the counter coupling 102 is mounted to the counter 200 and the main valve body 150 is fixed to the faucet 104, the faucet 104 can be coupled to the counter coupling 102. To do so, the main valve body 150 is placed over upper portion 126 so that the slots 160 of the bottom circular plate 158 descend over the keepers 130. As the faucet 104 is rotated clockwise, the bottom circular plate 158 is captured in the keeper channels 134 and passes up the ramp area 138 to butt against the plateau area 140 of the banking surface land 136. As a result, the faucet 104 is securely mounted to the counter coupling in the up-and-down or axial direction.

Figure 17:
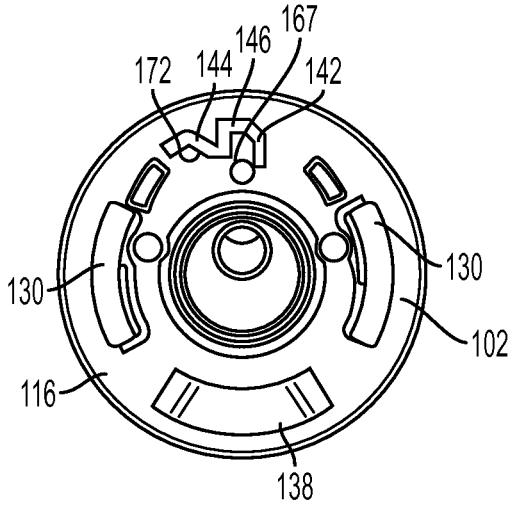
FIG. 17 is a somewhat schematic top disc shaped collar with the pin of the locking assembly included in the unlocked position to illustrate the interaction between the locking assembly and the locking land in accordance with the subject technology.
Figure 18:
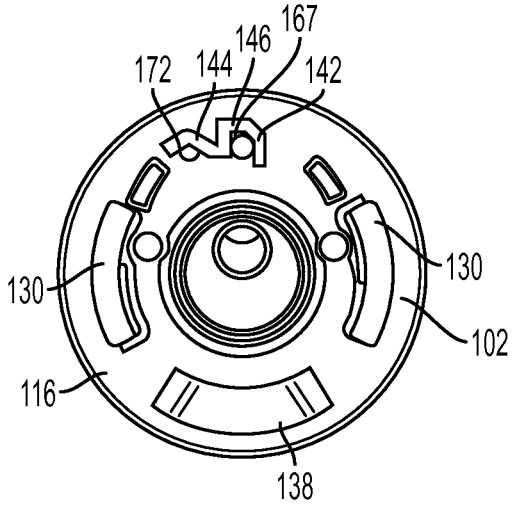
FIG. 18 is another somewhat schematic top disc shaped collar with the pin of the locking assembly included in the locked position to illustrate the interaction between the locking assembly and the locking land in accordance with the subject technology.

At the same time, the locking assembly 166 interacts with the locking land 142 to rotationally fix the faucet 104 in place. To illustrate the interaction between the locking assembly 166 and the locking land 142, refer to FIGS. 17 and 18. FIG. 17 is a somewhat schematic top disc shaped collar 116 with the pin 167 of the locking assembly 166 included in the unlocked position to illustrate the interaction between the locking assembly 166 and the locking land 142. FIG. 18 is the same view as FIG. 17 but with the pin 167 shown in the locked position.

During locking, the pin 167 rides along an angled outside portion 172 of the v-shaped part 144. Because the pin 167 is biased radially outward, when the pin 167 reaches the n-shaped part 146, the depending pin 167 is captured by nesting in the n-shaped part 145 as shown in FIG. 18.

To uncouple the faucet 104 from the counter coupling 102, the release button assembly 114 is pushed radially inward and, in turn, the depending pin 167 moves radially inward as shown in FIG. 17. As a result, the pin 167 is radially inward of the locking land 142 so that the faucet 104 can be rotated counter-clockwise and removed upward for service and/or replacement as desired. Preferably, the two opposing keepers 130, locking land 142 and banking surface land 136 are sized so that a turn of approximately 45 degrees couples and uncouples the faucet 104 from the counter coupling 102.

While the invention has been described with respect to preferred embodiments, those skilled in the art will readily appreciate that various changes and/or modifications can be made to the invention without departing from the spirit or scope of the invention.

What is claimed is:

1. A top-mount twist-on faucet assembly comprising:

a counter coupling having: a collar for mounting to a counter; a lower portion depending from the collar for coupling to a water source; an upper portion extending from the collar for coupling to a faucet; and at least one land having a v-shaped first part and a second n-shaped part; and the faucet having: a main body defining an axial bore for engaging the counter coupling and a release assembly passageway transverse to the bore; a dispensing tube extending from the main body; and a locking assembly for coupling to the at least one land to selectively couple the faucet to the counter coupling, wherein the locking assembly includes a release button extending radially outward and a pin depending from the passageway of the main body and coupled to the release button such that upon depression of the release button, the depending pin moves radially inward, wherein to couple the faucet to the counter coupling, the main body is placed over the upper portion and turned clockwise so that the pin rides along an outside of the first v-shaped part until the depending pin is captured by nesting in the second n-shaped part, and to uncouple the faucet from the counter coupling, the release button is pushed so that the depending pin moves out from nesting in the second n-shaped part, then the main body is turned counter-clockwise so that the pin rides again along the outside of the first v-shaped part and the faucet is freed from the upper portion.

2. A top-mount twist-on faucet assembly as recited in claim 1, wherein the collar is disc-shaped.

* * * * *